US008347418B2

(12) United States Patent
Murata

(10) Patent No.: US 8,347,418 B2
(45) Date of Patent: Jan. 8, 2013

(54) SHORTS

(76) Inventor: Ohki Murata, Yokohama (JP)

( * ) Notice: Subject to any disclaimer, the term of this patent is extended or adjusted under 35 U.S.C. 154(b) by 206 days.

(21) Appl. No.: 12/745,160

(22) PCT Filed: Nov. 27, 2008

(86) PCT No.: PCT/JP2008/071517

§ 371 (c)(1),
(2), (4) Date: Jun. 29, 2010

(87) PCT Pub. No.: WO2009/069686

PCT Pub. Date: Jun. 4, 2009

(65) Prior Publication Data

US 2010/0299811 A1 Dec. 2, 2010

(30) Foreign Application Priority Data

Nov. 28, 2007 (JP) ..... 2007-307004

(51) Int. Cl.
*A41B 9/00* (2006.01)
*A41D 7/00* (2006.01)

(52) U.S. Cl. ..... 2/400; 2/67; 2/406

(58) Field of Classification Search ..... 2/67, 400, 2/403, 406, 238, 401, 114, 402, 235–237, 2/219–221; D2/737, 738, 712
See application file for complete search history.

(56) References Cited

U.S. PATENT DOCUMENTS

| | | | | | |
|---|---|---|---|---|---|
| 2,085,425 | A | * | 6/1937 | Nash | 2/406 |
| 2,206,412 | A | * | 7/1940 | Levy | 2/46 |
| 2,450,789 | A | * | 10/1948 | Frieman | 604/397 |
| 3,207,158 | A | * | 9/1965 | Kazuko et al. | 604/394 |
| 4,121,305 | A | * | 10/1978 | Kolker | 2/406 |
| D293,156 | S | * | 12/1987 | Dunnagan | D2/737 |
| 4,940,463 | A | * | 7/1990 | Leathers et al. | 604/396 |
| 5,031,248 | A | * | 7/1991 | Kemper | 2/406 |
| 7,210,170 | B2 | * | 5/2007 | Lee | 2/67 |

FOREIGN PATENT DOCUMENTS

| | | |
|---|---|---|
| CN | 200973361 | 11/2007 |
| JP | 61-164208 | 10/1986 |
| JP | 1-164705 | 11/1989 |
| JP | 3-125002 | 12/1991 |
| JP | 4-044305 | 4/1992 |
| JP | 4-048213 | 4/1992 |
| JP | 2005-509098 | 4/2005 |

OTHER PUBLICATIONS

Bikini advertisement, Women's Health magazine, Jul. 2006, 2 pages.*

* cited by examiner

*Primary Examiner* — Amy Vanatta
(74) *Attorney, Agent, or Firm* — Jordan and Hamburg LLP

(57) ABSTRACT

Shorts having a constitution where the exposed skin area can be freely determined while a wearer wears the shorts without unnecessary physical or psychological burden is disposed. By connecting an approximately inverted triangular front cover and an approximately inverted triangular back cover at their tops of individual approximately inverted triangular shape, when the wearer wears the shorts, a lower abdomen, a crotch and buttocks of the wearer's body can be covered as one unit by the front and back covers. Further, by inserting a ring-shaped string into a string through passage made at upper hems of the front and back covers in a freely slidable manner, both ends of the upper hems of the front and back covers can be slid towards the center along the string and a state of the front and back covers is changeable to a narrow-width state to cover the lower abdomen, the crotch and the buttocks of the body.

5 Claims, 15 Drawing Sheets

SHORTS

BACKGROUND OF THE INVENTION

The present invention relates to shorts mainly in the field of clothing, sanitary supplies, medical supplies, or the like, preferably to shorts worn by those who get an esthetic service or a beauty treatment over their whole bodies.

The demand for a beauty treatment service or cosmetology service over the whole body (i.e. so called esthetic service) is recently increasing mainly among women. Generally, the beauty treatment includes a full body massage after applying cosmetic liquid and oil on the skin and depilation to remove unnecessary hair.

In a facility where such esthetic service is provided (i.e. in an esthetic saloon) it is a general practice to prepare temporary clothing for a client to wear during the treatment in order to expose the skin of the client and avoid the case where the clients' clothes get dirty or damaged. It is known that disposable shorts made of non-woven fabric are used as an example of such temporary clothing. (e.g. ref. Patent document 1) Patent document 1: JP2005-509098A

SUMMARY OF THE INVENTION

However, in the case of the conventional shorts, there were problems such as the following when the massage or depilation treatment was applied on one portion, namely the lower abdomen or buttocks covered by the shorts.

For example, when the client is asked to take off the shorts, in many cases the clients hesitate to do so, due to embarrassment because they were conscious of others such as the beautician or other clients, even if they are the same gender, watching them. In addition, when the treatment is done while the shorts are being worn, in order to let the area where the treatment is being applied be exposed, it is necessary to move the crotch of the shorts to the center by hand and change the shape and as a result the treatment is not performed smoothly or the client becomes uncomfortable because the area on which pressure is forcibly applied produces pressure or tense feelings on the body of the client.

Accordingly, it is an object of the present invention to provide the wearer with shorts where the exposed skin area can be freely determined while wearing the shorts without any unnecessary physical or psychological burden.

To achieve the above purpose, the present invention provides the following shorts.

(1) Shorts comprising an approximately inverted rectangular front cover and an approximately inverted rectangular back cover, each top of which is connected together in order to cover the lower abdomen, crotch and buttocks of the body as one unit by the front and back covers while being worn. Further, a ring-shaped string is inserted in a free slidable manner into string through passages that are formed at the upper hems of the front and back covers. Thus, the both ends of the upper hems of the front and back covers can be slid along the string toward the center so that the shape of the front and back covers can be changed to cover the lower abdomen and buttocks of the body while narrowing the width. Besides, in case the shape of the front and back covers is changed to a narrow-width state while being worn, the right and left side portions of the ring-shaped string are positioned on the right and left sides of the pelvis and the front and back side portions of the ring-shaped string form approximately V shapes seen from the front and back sides.

In accordance with the shorts described in (1) above, a client who wears the shorts (hereinafter called as "the wearer") can change freely, while wearing the shorts, the area of the front and back covers which cover the lower abdomen and buttocks by sliding the both ends of the upper hems of the front and back covers toward the center along the string.

Accordingly, when an esthetic service is provided, the wearer can, while wearing the shorts, expose easily the skin portion of the lower abdomen and buttocks where such treatment is applied and it is no longer necessary to take off the shorts or deform the shape of the shorts forcibly. As a result, the wearer does not feel embarrassed or unpleasant and it is now possible to avoid any unnecessary physical or psychological burden on the wearer.

(2) Shorts having a specific feature where the both ends of the upper hems of the front and back covers do not slide beyond approximately to the center of the hems when the both ends of the upper hems of the front and back covers are made to slide along the string toward the center.

According to the shorts described in (2) above, it becomes possible to avoid a case where the width of the front and back covers becomes too narrow if they are slipped to either the left or right direction from the center when the both ends of the upper hems of the front and back covers are slid along the string toward the center. Accordingly, it is appropriate to avoid any unnecessary physical or psychological burden on the wearer.

(3) Shorts described in (1) and (2) are characterized by having string made of elastic material.

In accordance with the shorts described in (3) above, since the string of the shorts can be extended according to the waist size of the wearer, it is possible not to limit those who can wear the shorts.

(4) Shorts described in any one of (1) to (3) above are characterized by fixing the approximately center of the upper hems of the front and back covers to the string.

In accordance with the shorts described in (4) above, it becomes possible to enhance its certainty in preventing the formation of a too narrow width formed by slipping to either the right or left direction when the both ends of the upper hems of the front and back covers are slid along the string toward the center. Therefore it is appropriate to avoid unnecessary physical or psychological burden on the wearer.

(5) Shorts described in any one of (1) to (4) above are characterized by having the free ends on the string and by forming a ring-shaped string by tying each end.

In accordance with the shorts described in (5) above, it becomes possible not to limit those who wear the shorts since they can adjust the length of the string of the shorts according to their waist size or up to the point where they feel comfortable.

(6) Shorts described in any one of (1) to (5) above are characterized in that the first string is formed on the left end of the upper hem of the front cover and the second string is formed on the right end of the upper hem of the front cover respectively, and the third string is formed on the left end of the upper hem of the back cover and the fourth string is formed on the right end of the upper hem of the back cover respectively and further in that when the width of the front cover is changed to a narrow width state while being worn, the free end of the first string and the free end of the second string are fastened to each other and when the width of the back cover is changed to a narrow width state while being worn, the free end of the third string and the free end of the fourth string are fastened to each other, thus preventing the both right and left ends of the upper hems of the front and back covers from sliding along the string from the center to the right and left sides.

In accordance with the shorts in (6) above, when the width of the front and back covers is changed to a narrow width state while being worn, it is possible to prevent both the right and left ends of the upper hems from sliding to the right and left sides from the center by fastening the free ends of the string formed on the right and left ends of the upper hems of the front and back covers. As a result, the shapes of the front and back covers can be maintained in a narrow width state.

(7) Shorts described in (6) above are characterized by preventing the right and left ends of the upper hems of the front and back covers from sliding along the string to the center from the right and left sides by fastening the free end of the first string and the free end of the third string and also by fastening the free end of the second string and the free end of the fourth string, when the shape of the front and back covers is not changed to a narrow width state while the shorts are being worn.

In accordance with the shorts in (7) above it becomes possible to prevent the right and left ends of the upper hems of the front and back covers from sliding along the string to the center from the right and left sides by fastening the free ends of the string on the right and left ends of the upper hem of the front cover and the corresponding free ends of the string on the right and left ends of the upper hem of the back cover when the shape of the front and back covers is not changed to a narrow state while the shorts are being worn. As a result, it becomes possible to maintain the shape of the front and back covers and not to become narrow.

In accordance with the shorts of the present invention, it becomes possible to change freely the area of the lower abdomen and buttocks to be covered by the front and back covers while wearing the shorts. Further, when the client is provided with the esthetic treatment service with the shorts of the present invention on, since she or he can easily expose the portion of the lower abdomen and buttocks where the treatment is applied, it is possible not to give unnecessary physical or psychological burden on the client.

DETAILED DESCRIPTION OF THE INVENTION

Figure 1:
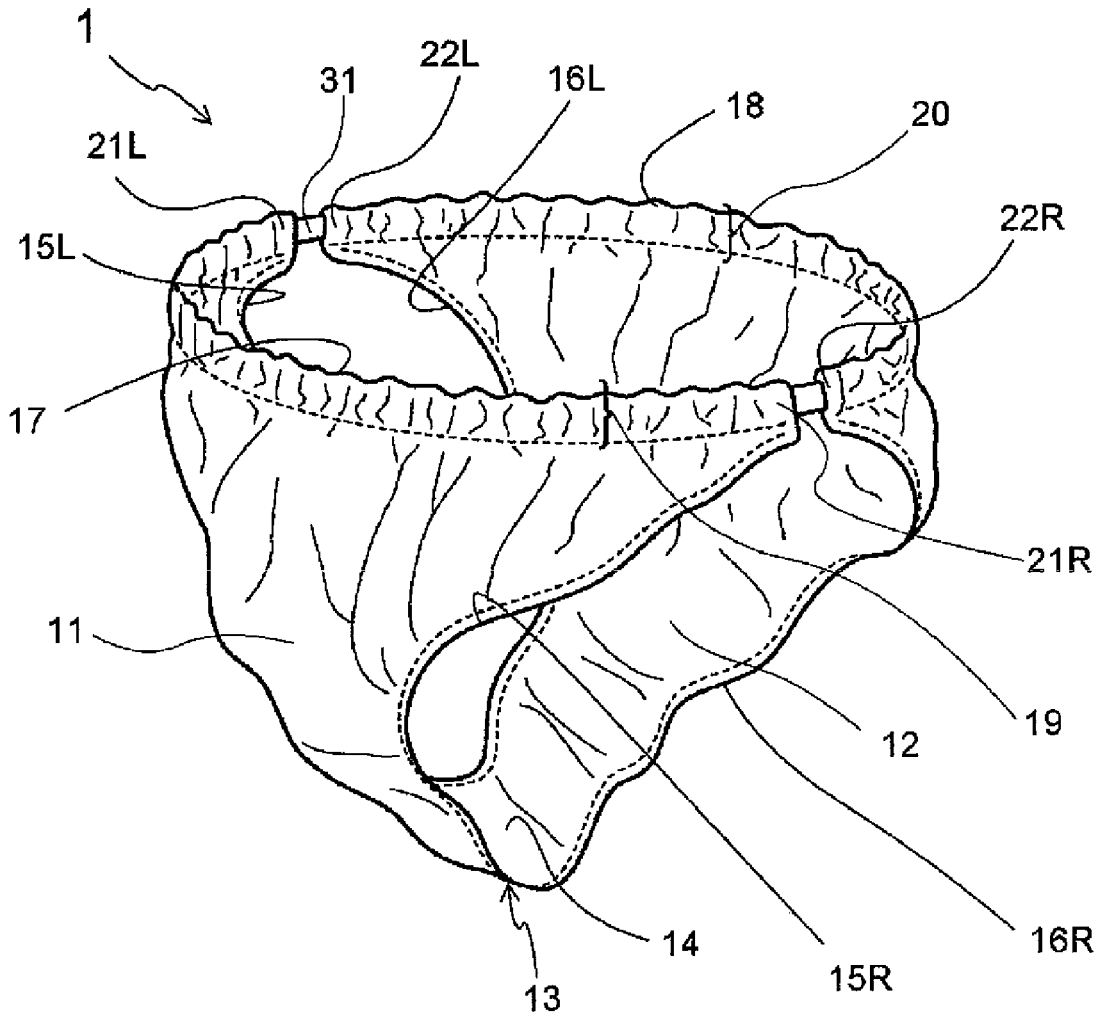
FIG. 1: Perspective view of the whole construction of the shorts (1)

Shorts (1) adopted in an embodiment of the present invention are explained referring to the following drawings (FIG. 1-FIG. 12). First, with reference to FIG. 1 the whole construction of the shorts (1) is explained. FIG. 1 is a perspective view of the whole construction of the shorts (1) regarding the embodiment of the present invention.

Shorts (1) include the front cover (11) (corresponding to the main front piece) of a fabric material of an approximately inverted triangular shape and the back cover (12) (corresponding to the main back piece) which has almost the same area and shape as the front cover (11) of a fabric material of an approximately inverted triangular shape and a top (13) formed by an approximately inverted triangular shape connecting the front cover (11) and the back cover (12).

When the front cover (11) and the back cover (12) are connected at the top of (13) of the approximately inverted triangular shape, the extending fabric from each top is folded over and sewn, thus forming the crotch (14), which reinforces the portion which faces the bottom of the wearer.

Besides, both side ends (15L and 15R) (which correspond to the slanting sides of the approximately inverted triangular shape) of the front cover (11) and both side ends (16L and 16R) of the back cover (12) form the portion where each leg is inserted respectively on the right and left sides.

And as will be explained in details later, the upper hem (17) (which corresponds to the base of the approximately inverted triangular shape) of the front cover (11) and the upper hem (18) of the back cover (12) are connected respectively with a ring-shaped string (31) which is explained later and form the waist portion which can be slid along the string (31).

The front cover (11) and back cover (12) are constituted non-woven fabric. As the material of which the non-woven fabric is made, a suitable material is chosen from such fiber as natural fiber including cotton and pulp and chemical fiber including rayon, polyester, polypropylene, etc. as well as combinations of the aforementioned materials. Besides, it is preferable to choose such non-woven fabric which prevents the skin of the lower abdomen and buttocks from being seen through the shorts (1) while they are being worn.

Further, when an application of the shorts, namely the esthetic service is taken into consideration, it is preferable to use, for example, white, pink or orange colors and not to use such colors as black, blue near black or brown. There is a possibility of scorching the fabric when the depilation treatment is performed by applying visible rays of a given wavelength (for example under the neighborhood of 755 mm) (so called laser depilation) to the designated part and it is for the above reason that such colors should be chosen.

Figure 2:
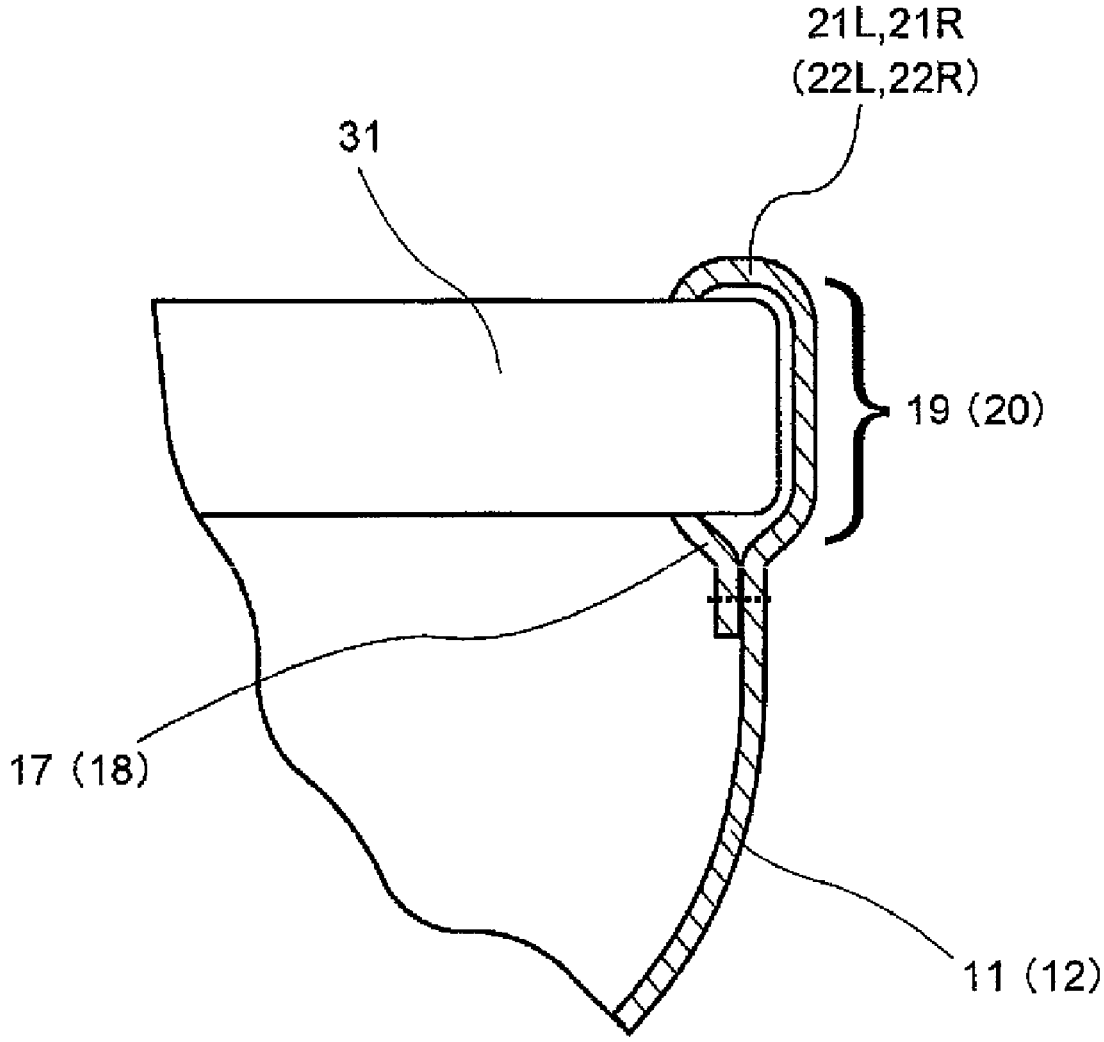
FIG. 2: Enlarged view showing the essential portions of the shorts (1)

Next, with reference to FIG. 1 and FIG. 2 mentioned above, the construction of an important part of the shorts (1), namely the waist part which is made to slide is explained. FIG. 2 is a magnified drawing of the right and left ends of the upper hem portion of the front cover (11) and the back cover (12) of the shorts (1).

The upper hem (17) of the front cover (11) is folded inside (to the side which faces the surface of the body when the shorts are worn) between the right and left ends and sewn with a given amount of room to form a tube-shaped folded part (hereinafter referred to as the string through passage) (19) through which the string (31) (which is explained later) is passed. Similarly, the upper hem (18) of the back cover (12) is folded inside between the right and left ends and sewn with a given amount of room to form the string through passage (20).

The string (31) which is passed through the string through passages (19) and (20) forms a ring-shaped string by connecting the both ends of the flat-shaped rubber. In the embodiment of the present invention by making the string (31) flat-shaped, the area which contacts the skin around the waist of the wearer increases and the pressure on it is dispersed. As a result, any unpleasantness is reduced.

Further, the length of the string through passage (19) formed at the upper hem (17) of the front cover (11) (namely, the length between the right and left ends of the upper hem (17)) and the length of the string through passage (20) formed at the upper hem (18) of the back cover (12) are equivalent to approximately half of the circumference of the string (31) (the length of the waist) respectively. In other words, the upper hem (17) of the front cover (11) and the upper hem (18) of the back cover (12) are wide enough to cover the whole part of the string (31) in the string through passages (19) and (20) formed respectively when the string (31) is passed through.

As shown in FIG. 1, the left end (21L) of the upper hem (17) of the front cover (11) and the left end (22L) of the upper hem (18) of the back cover (12) are not connected to each other but end freely in the shorts (1) in the embodiment of the present invention. Further, the right end (21R) of the upper hem (17) of the front cover (11) and the right end (22R) of the upper hem (18) of the back cover (12) are not connected to each other but end freely. By doing so when the string (31) is passed through the string through passages (19) and (20), the upper hem (17) of the front cover (11) and the upper hem (18) of the back cover (18) can be slid independently along the string (31).

The size of the loophole in which the string (31) is passed through of the string through passages (19 and 20) is preferably adjusted so as not to be too tight or too loose when the upper hem (17) of the front cover (11) and the upper hem (18) of the back cover (12) are slid along the string (31).

Further, as shown in FIG. 1 in the whole part of each passage (19 and 20), namely between the right and left ends of the upper hem (17) of the front cover (11) and between the right and left ends of the upper hem (18) of the back cover (12) gathers are formed respectively all over. With the above, it is easy to expand and contract from the right and left the upper hem (17) of the front cover (11) and the upper hem (18) of the back cover (12) respectively along the string (31). Further, it is possible to adjust for the expansion of the waist along with elongation of the string (31) and to avoid the deterioration of the appearance.

Figure 3:
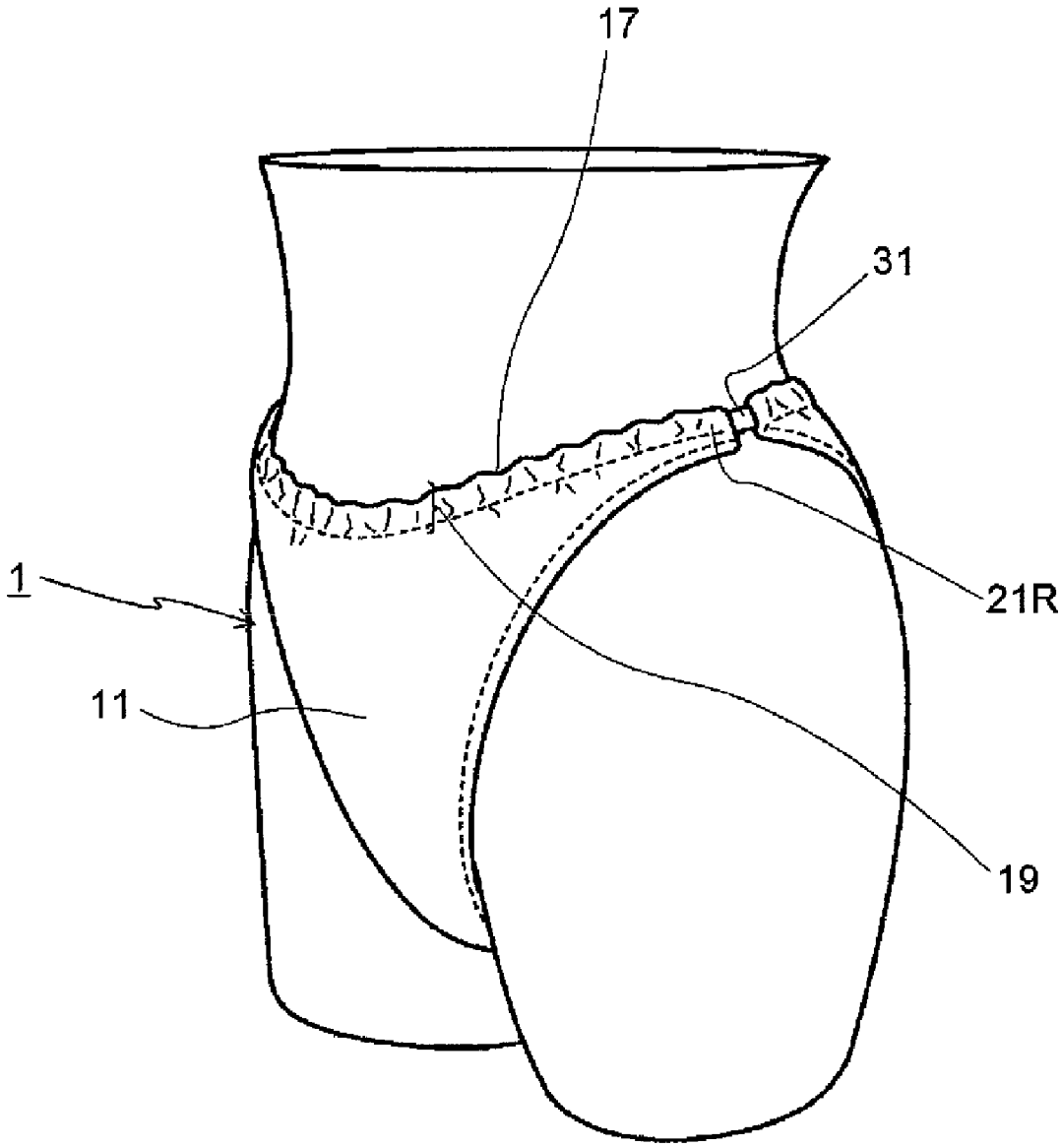
FIG. 3: Perspective view of the external appearance of the shorts (1) while being worn
Figure 9:
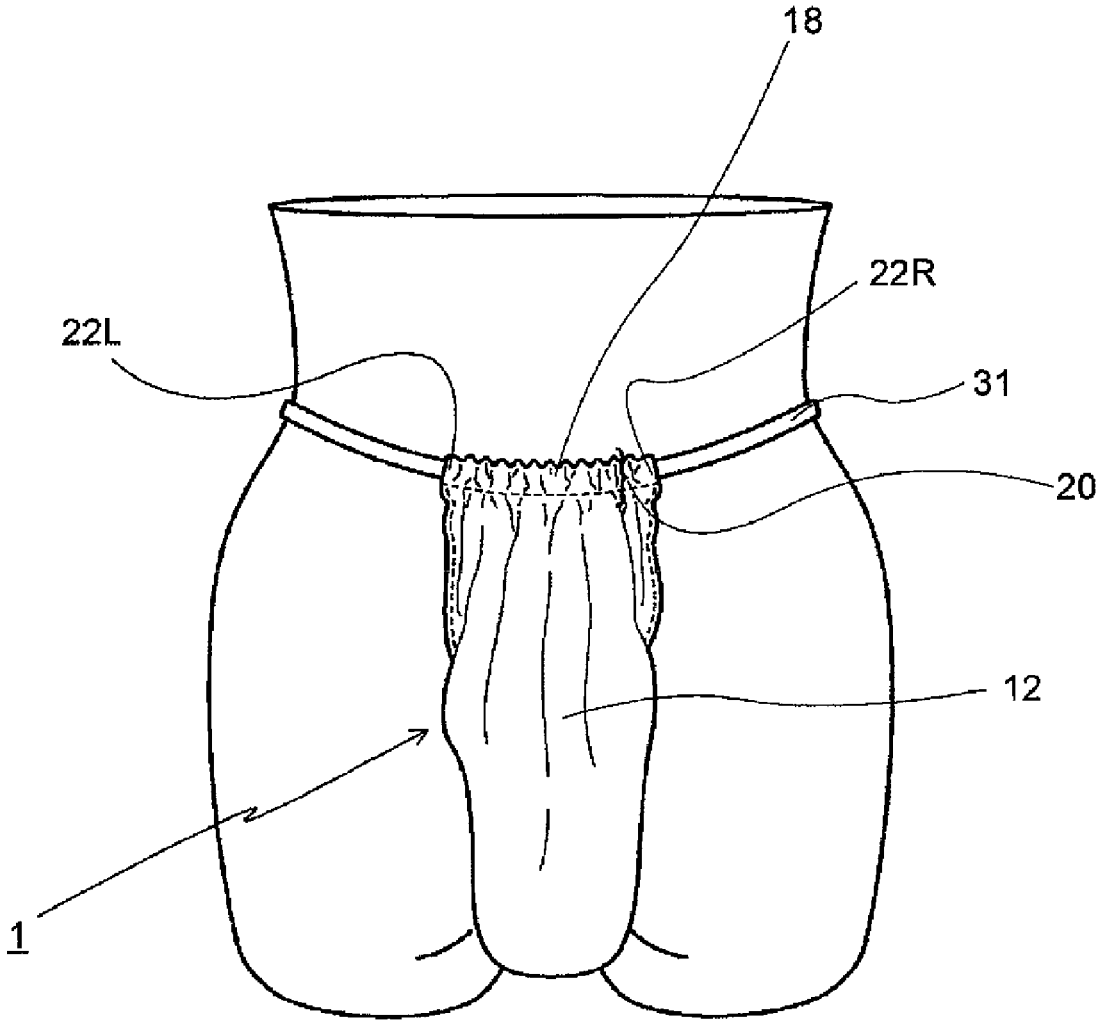
FIG. 9: Back side view of the external appearance of the shorts (1) when they have been changed

Next, referring to FIGS. 3 and 9 the function is explained when the shorts (1) are put on.

Figure 4:
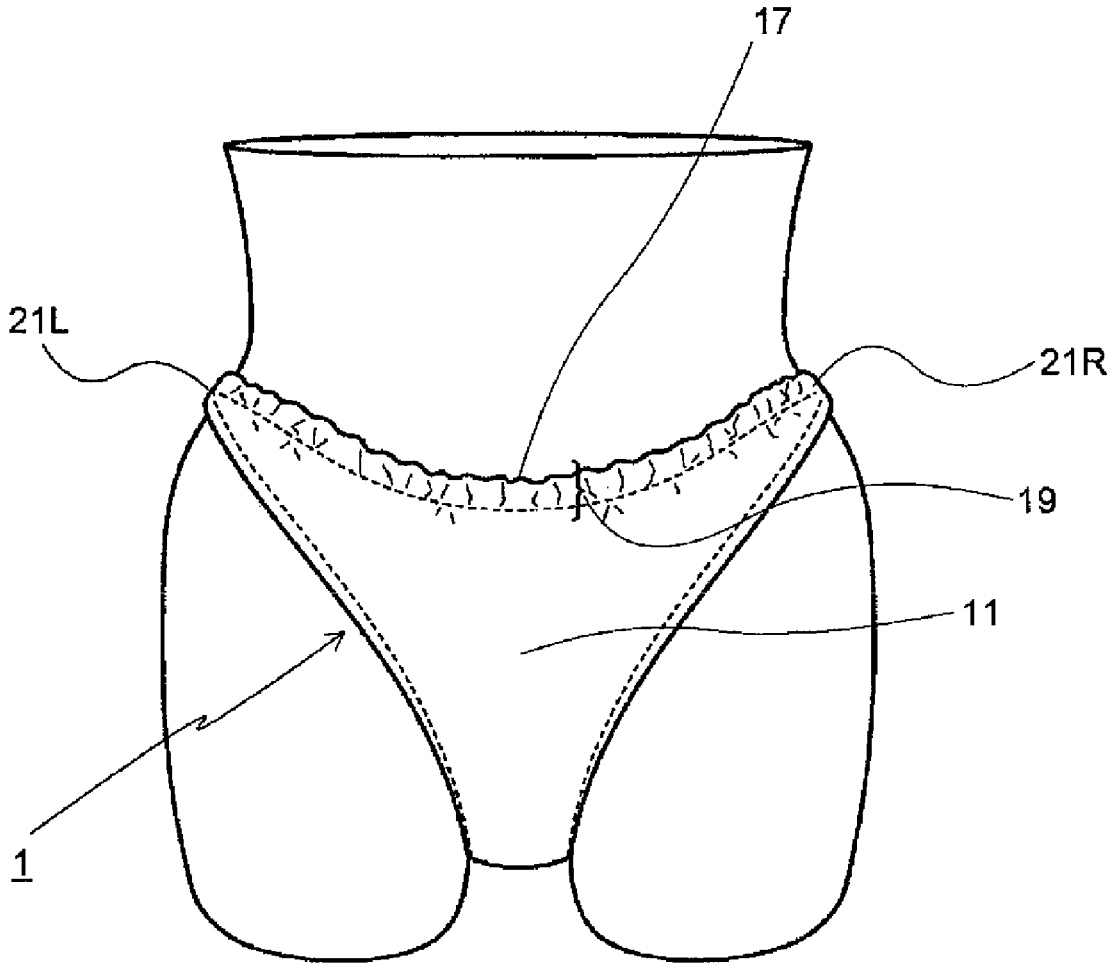
FIG. 4: Front view of the external appearance of the shorts (1) while being worn
Figure 5:
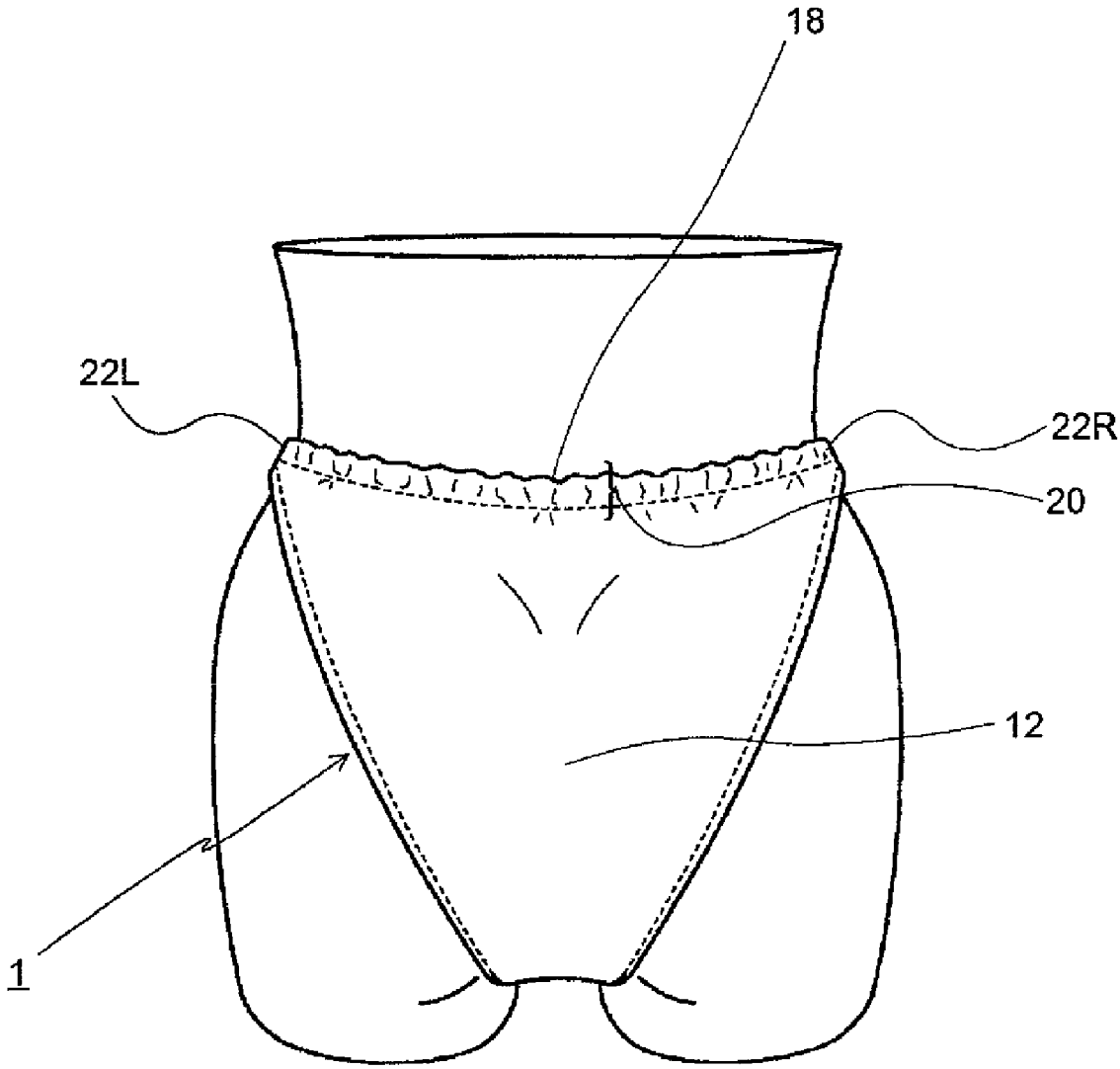
FIG. 5: Back side view of the external appearance of the shorts (1) while being worn

FIG. 3 is a perspective view of the external appearance of the shorts (1) while being worn. FIG. 4 is a front view of the external appearance of the shorts (1) while being worn. FIG. 5 is a back side view of the external appearance of the shorts (1) while being worn.

As shown in FIG. 3-FIG. 5 when the shorts (1) of the present invention are put on, the right and left sides of the string (31) are suspended on the right and left sides of the pelvis of the wearer (to be more concrete, the rising portions of Spina iliaca anterior superior or Crista iliaca constituting the Os ilium) and the whole area of the lower abdomen, crotch and buttocks of the wearer are covered as one unit by the front cover (11) and the back cover (12) of an approximately inverted triangular shape. In other words, the shorts (1) as shown in FIG. 3-FIG. 5 are in a state which can maintain the shape of shorts in general (hereinafter called "the normal state").

Figure 6:
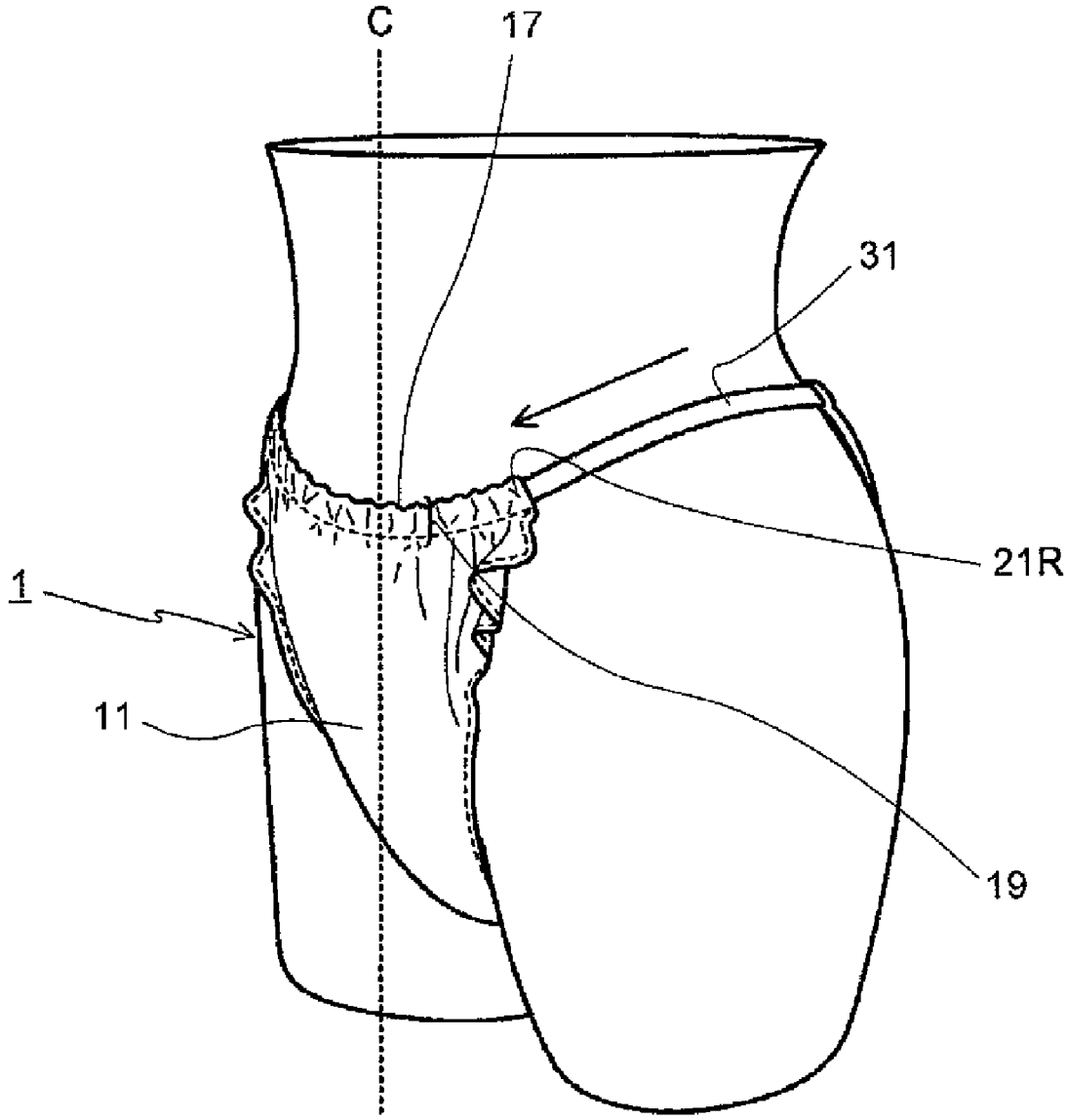
FIG. 6: Perspective view of the external appearance of the shorts (1) when they have been adjusted
Figure 7:
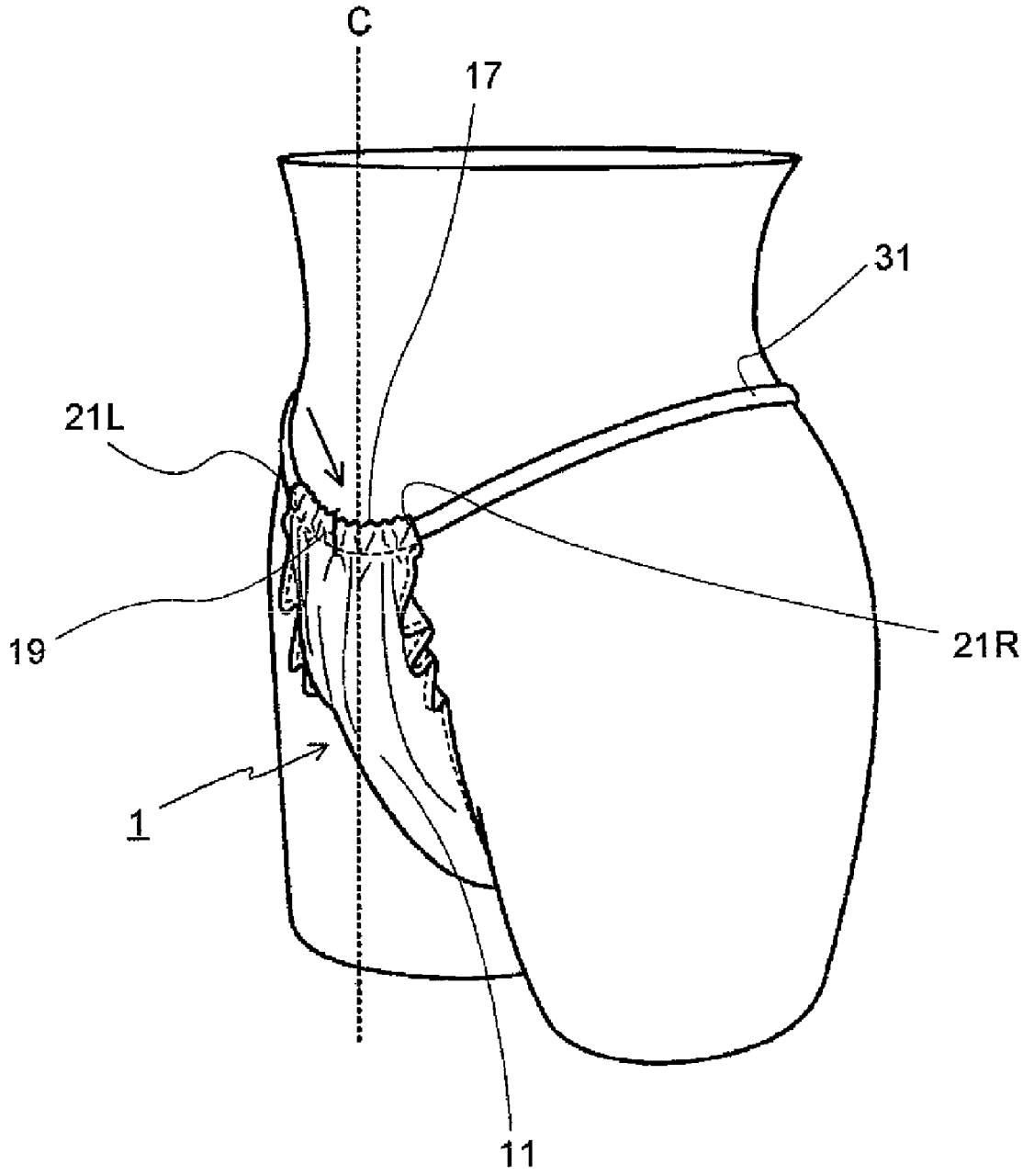
FIG. 7: Perspective view of the external appearance of the shorts (1) when they have been changed
Figure 8:
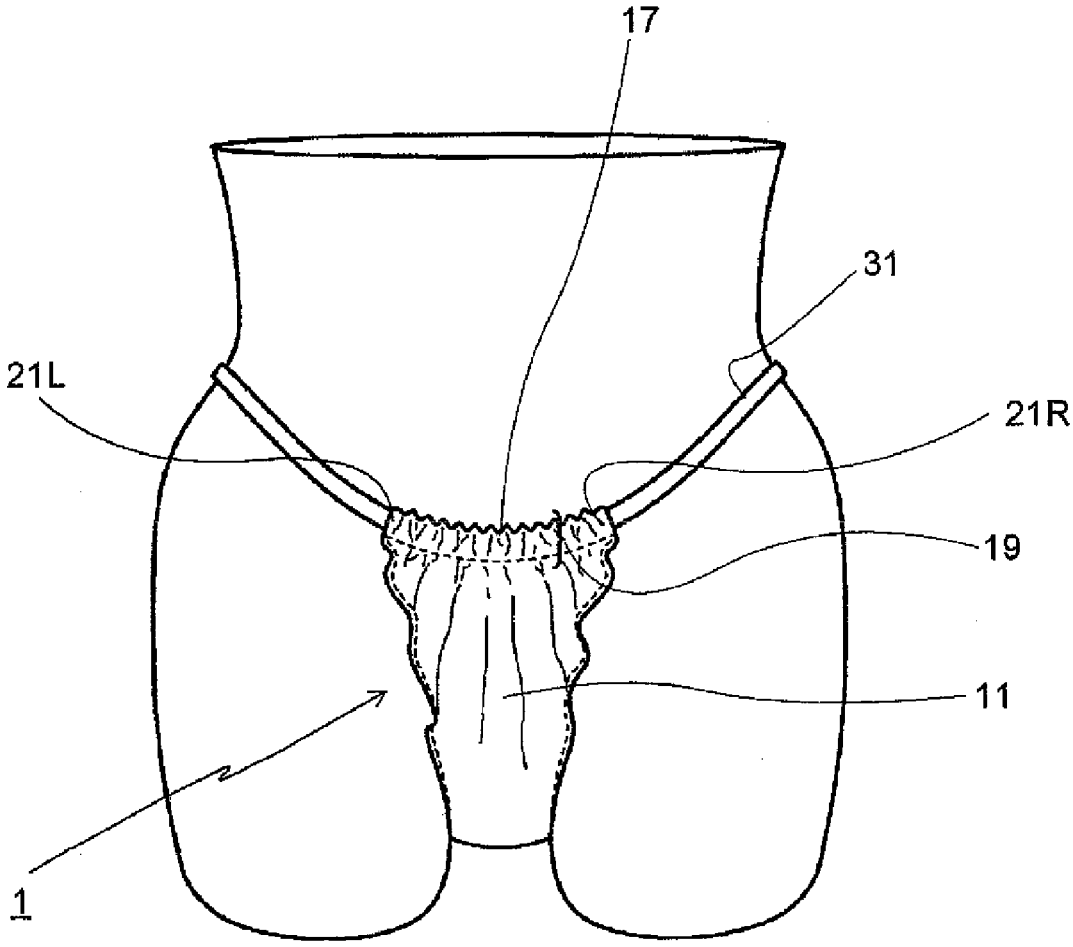
FIG. 8: Front view of the external appearance of the shorts (1) when they have been changed

FIG. 6 and FIG. 7 are perspective views of the external appearance of the shorts (1) when they are changed while they are being worn. FIG. 8 is a front view of the external appearance of the shorts (1) when they are changed while they are being worn. FIG. 9 is back side view of the external appearance of the shorts (1) when they are changed while they are being worn.

As shown in FIG. 6, when the right end (21R) of the upper hem (17) of the front cover (11) is slid along the string (31) to the center C of the front cover (or to the center of the lower abdomen of the wearer), the cloth is gathered from the right end (21R) of the upper hem (17) to the center (C) and its width is narrowed, while the right end of the string (31) is suspended on the right side of the pelvis of the wearer.

Further at this time, because of the thickness of the gathers and the existence of fabric between the center (C) and the left end (21L) of the upper hem (17), as it is drawn from the right end (21R) towards the center (C) of the upper hem (17), the right end (21R) of the upper hem (17) is duly prevented from moving beyond the center (C) towards the left upper-side.

As a result, the fabric which constitutes the right half of the front cover (11) from the center (C) is drawn towards the center (C), thereby the area covered by the front cover (11) is reduced.

In the same manner, as shown in the FIG. 7, when sliding the left end (21L) of the upper hem (17) of the front cover (11) along the string (31) towards the center (C), the left side of the string (31) remains on the position on the left side of the wearer's pelvis while the fabric is drawn from the left end (21L) of the upper hem (17) towards the center (C), whereby the width of the covering is narrowed.

Further, at this time, because of the thickness of the gathers as it is drawn from the left end (21L) towards the center (C) of the upper hem (17), as well as the thickness of the gathers as the fabric is drawn from the right end (21R) of the upper hem (17) towards the center (C), as described above, the left end (21L) of the upper hem (17) is duly prevented from moving beyond the center (C) towards the right upper-side.

As a result, the left half fabric of the front cover (11) from the center (C) is drawn towards the center (C), thereby reducing the area covered by it.

This means, as shown in FIG. 8, that area covered by the front cover (11) is narrowed to the lower abdomen and crotch in the approximately rectangular shape as the width of the approximately inverted triangular front cover (11) is narrowed towards the center. Thus, the area which has normally been covered by the front cover (11) is exposed (except for the area near a part), without taking the shorts (1) off.

In this case, as shown in the drawing, when it is changed from the normal state to the narrow-width state, the left and the right sides of the string (31) remain on the position of the left and the right sides of the pelvis of the wearer, as the left and the right sides of the upper hem (17) are slid towards the center (C), the front and the back sides of the string (31) become approximately V shape seen from front and back sides.

As described above, in the same manner as the front cover (11) is displaced, if the left and the right ends (22L and 22R) of the upper hem (18) of the back cover (12) are slid along the string (31) towards the center (C), the left and the right sides of the string (31) remain on the position of the left and the right sides of the pelvis of the wearer while the fabric is drawn from the left and the right ends (22L and 22R) of the upper hem (18) towards the center (C), and the width is reduced. As a result, the fabric of the back cover (12) at the left and right sides of the center (C) is gathered towards the center (C), and the area it covers is reduced.

This means, as shown in FIG. 9, that the area covered by the back cover (12) is narrowed to cover the buttocks and the crotch of the wearer. Thus, the area which is normally covered by the back cover (12) is exposed, without taking the shorts (1) off (except for the area near the natal cleft or butt crack).

In this case, as shown in the drawing and as in the case for the front cover (11), when it is changed to the narrow-width state as described above, the left and the right sides of the string (31) remain on the position of the left and the right sides of the pelvis of the wearer, the front and the back sides of the string (31) become approximately V shape seen from the front and back sides.

As explained above, the shorts (1) of the embodiment are constituted to cover the lower abdomen, crotch and buttocks of the wearer as one unit at the normal state (ref. FIGS. 3 to 5) when being worn, at the same time, are constituted to changeably cover the lower abdomen, crotch and buttocks of the wearer at the narrowed-width state (ref. FIGS. 7 to 9) by the slidable left and right ends (21L and 21R) of the upper hem (17) of the front cover (11) and by the slidable left and right ends (22L and 22R) of the upper hem (18) of the back cover (12) along the string (31) towards the center (C) without taking the shorts (1) off.

The wearer, thus, can change freely the area of the lower abdomen covered by the front cover (11) and the area of the buttocks by the back cover (12) respectively without taking the shorts (1) off.

In case of offering esthetic services, by letting the wearer wear the shorts (1) of the embodiment, it becomes possible to easily expose the area of skin in the lower abdomen and/or buttocks where treatments are to be exercised with wearing the shorts. It is not necessary, therefore, to let the wearer take off the shorts unnecessarily requiring her to feel embarrassment. It is, in addition, not necessary to force deformation of the shorts, relieving the wearer from uncomfortable feelings due to deformation. As a result, it becomes possible not to unnecessarily burden the wearer physically and/or psychologically.

Additionally, as described before, the shorts (1) of the embodiment are designed to have similar form as normal shorts at the normal state of wearing, and they are devised to increase the area of skin to be exposed as necessary. Thus, unlike in the case of wearing shorts with fabric designed to cover small area in the lower abdomen and/or buttocks (so called T-back, etc.) whereby the exposed skin area is remarkably large from the beginning, it is possible to avoid wearers' feeling of resentment from shyness.

Further, the shorts (1) of the embodiment are constructed in such way when constructing the left and/or the right ends (21L and 21R) of the upper hem (17) of the front cover (11) and the left and/or the right ends (22L and 22R) of the upper hem (18) of the back cover (12) slidable along the string (31) towards the center (C), that sliding of the left and/or the right ends (21L and 21R) of the upper hem (17) of the front cover (11) or the left and/or the right ends (22L and 22R) of the upper hem (18) of the back cover (12) is not allowed to slide beyond the center (C) to opposite sides.

In this way, when it is configured such that the left and/or the right ends (21L and 21R) of the upper hem (17) of the front cover (11) and the left and/or the right ends (22L and 22R) of the upper hem (18) of the back cover (12) are slidable along the string (31) towards the center (C), it is possible to prevent the narrow-width state being formed on either left or right side deviating from the center (C). As a result, it is favorable so as not to unnecessarily burden the wearer physically and/or psychologically.

The string (31) of the shorts (1) of the form of the embodiment is constructed with flat-shaped rubber and this makes it possible to adjust in accordance with the waist-size of the wearer by the elasticity of the string (31) of the shorts (1), thus the applicable wearers are not unnecessarily limited.

Now, referring to FIGS. 10 to 15, explanations for the shorts (1) adopting another of the embodiment of the present invention are given.

The shorts (1) shown in FIGS. 10 to 15 have the first string-shaped material (23L) at the left end (21L) of the upper hem (17) of the front cover (11), as well as the second string-shaped material (23R) at the right end (21R) of the upper hem (17) of the front cover (11). In addition, on the back cover (12), they have the third string-shaped material (24L) at the left end (22L) of the upper hem (18), as well as the fourth string-shaped material (24R) at the right end (22R) of the upper hem (18). Furthermore, the string-shaped material (23 and 24) is constructed to have enough length to fasten with each other respectively as described below.

Figure 10:
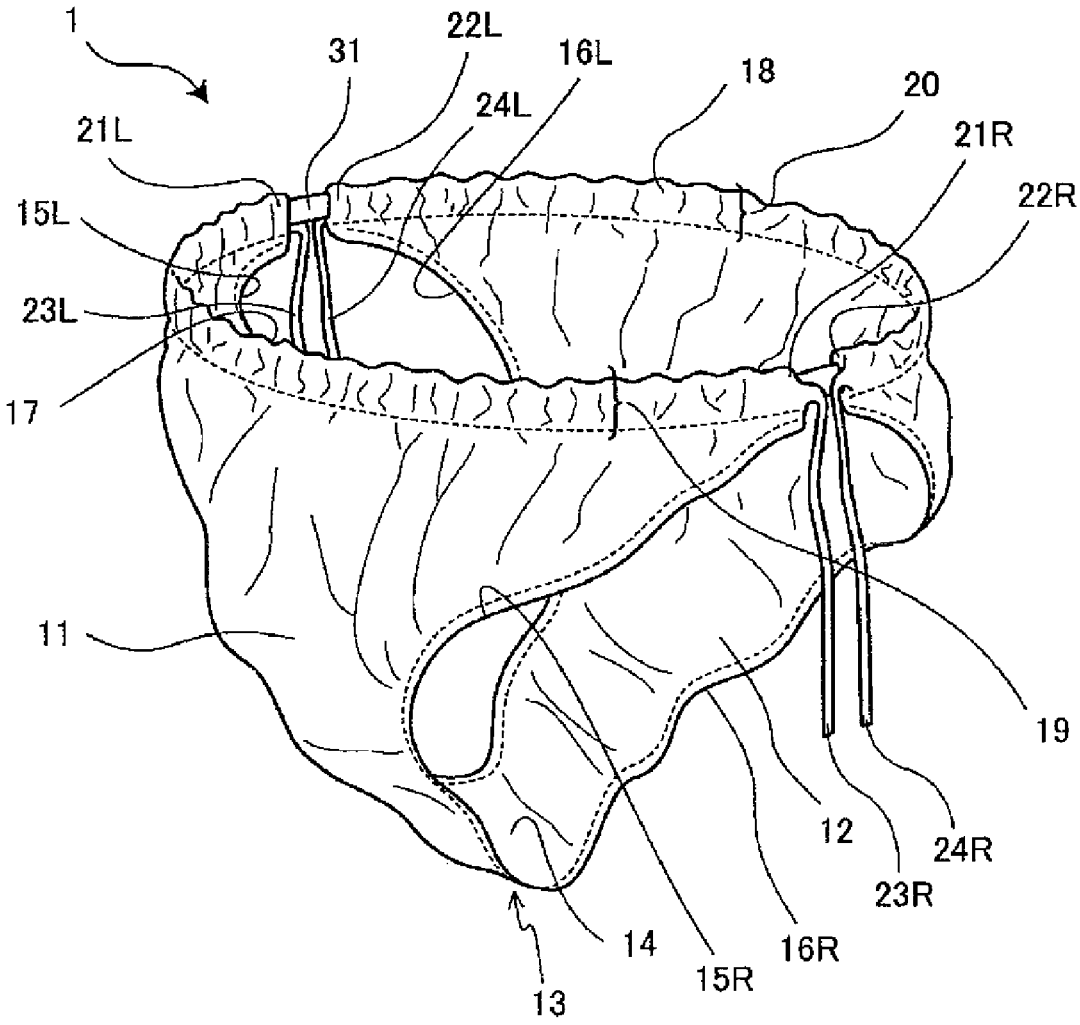
FIG. 10: Perspective view of the whole construction of the shorts (1)
Figure 13:
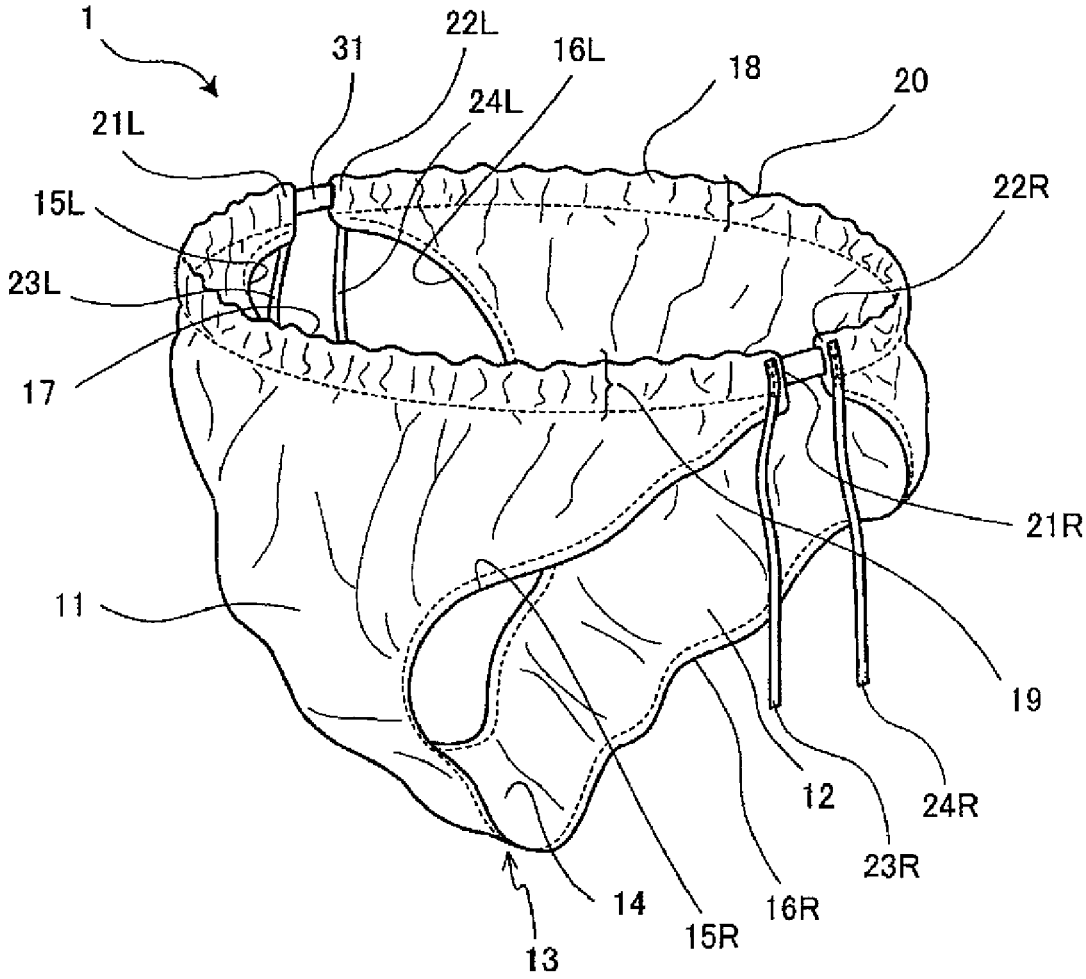
FIG. 13: Perspective view of the whole construction of the shorts (1)
Figure 14:
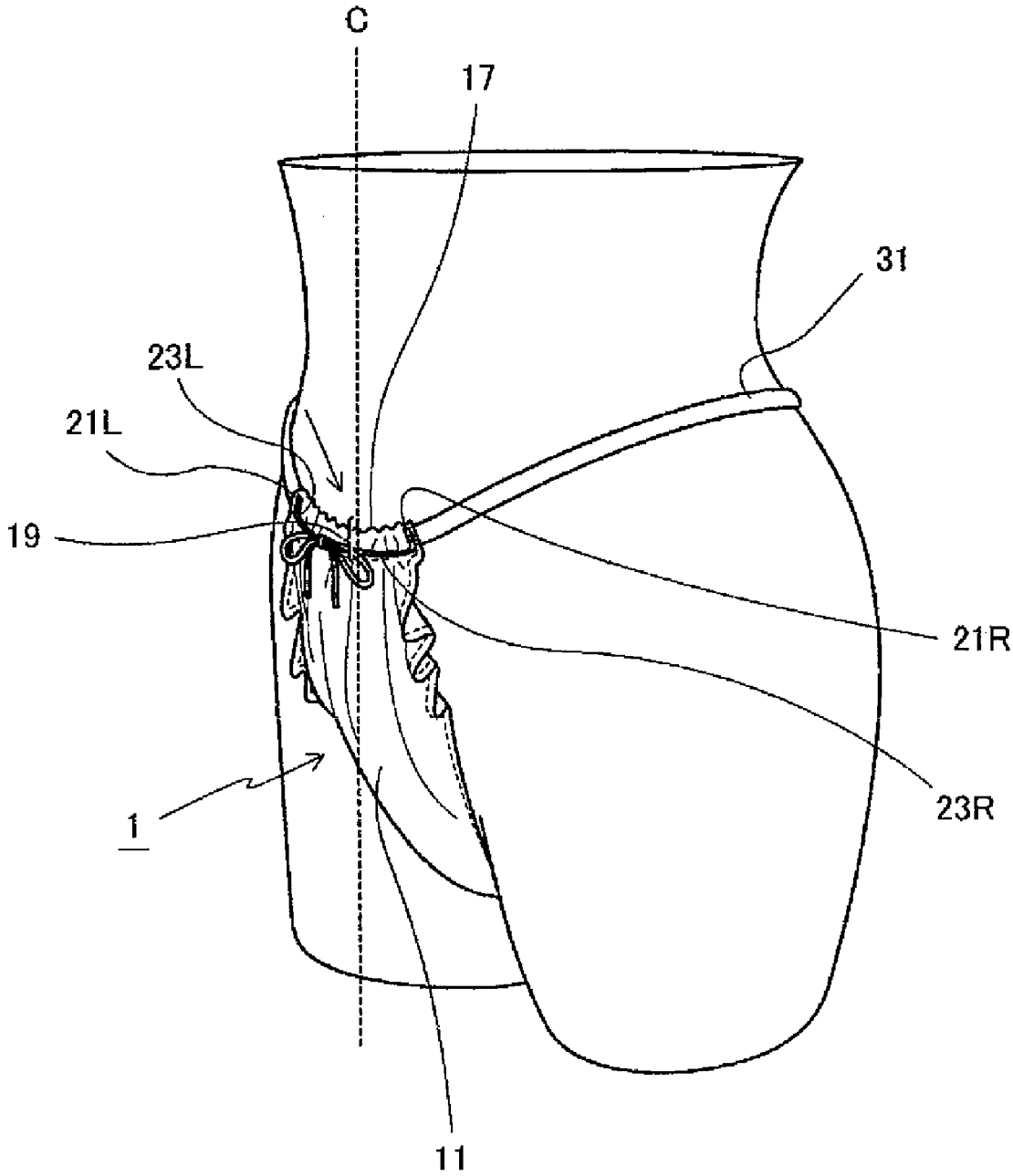
FIG. 14: Perspective view of the external appearance of the shorts (1) while being worn

In the embodiment, the first string-shaped material (23L) and the second string-shaped material (23R) are constructed to be integrated to the front cover (11), as shown in FIG. 10. In other words, the both string-shaped material (23L and 23R) are cut out from the fabric constituting said approximately inverted triangular front cover at the time of cutting out. Incidentally, as shown in FIG. 13, it is possible to prepare the first string-shaped material (23L) and the second string-shaped material (23R) separately from the front cover (11) and fix the first string-shaped material (23L) to the left end (21L) and the second string-shaped material (23R) to the right end (21R) both of the upper hem (17) of the front cover (11) by means of suturing or otherwise. The relation between the back cover (12) and the third string-shaped material (24L) and the fourth string-shaped material (24R) is the same as that between the front cover (11) and the first string-shaped material (23L) and the second string-shaped material (23R).

Figure 11:
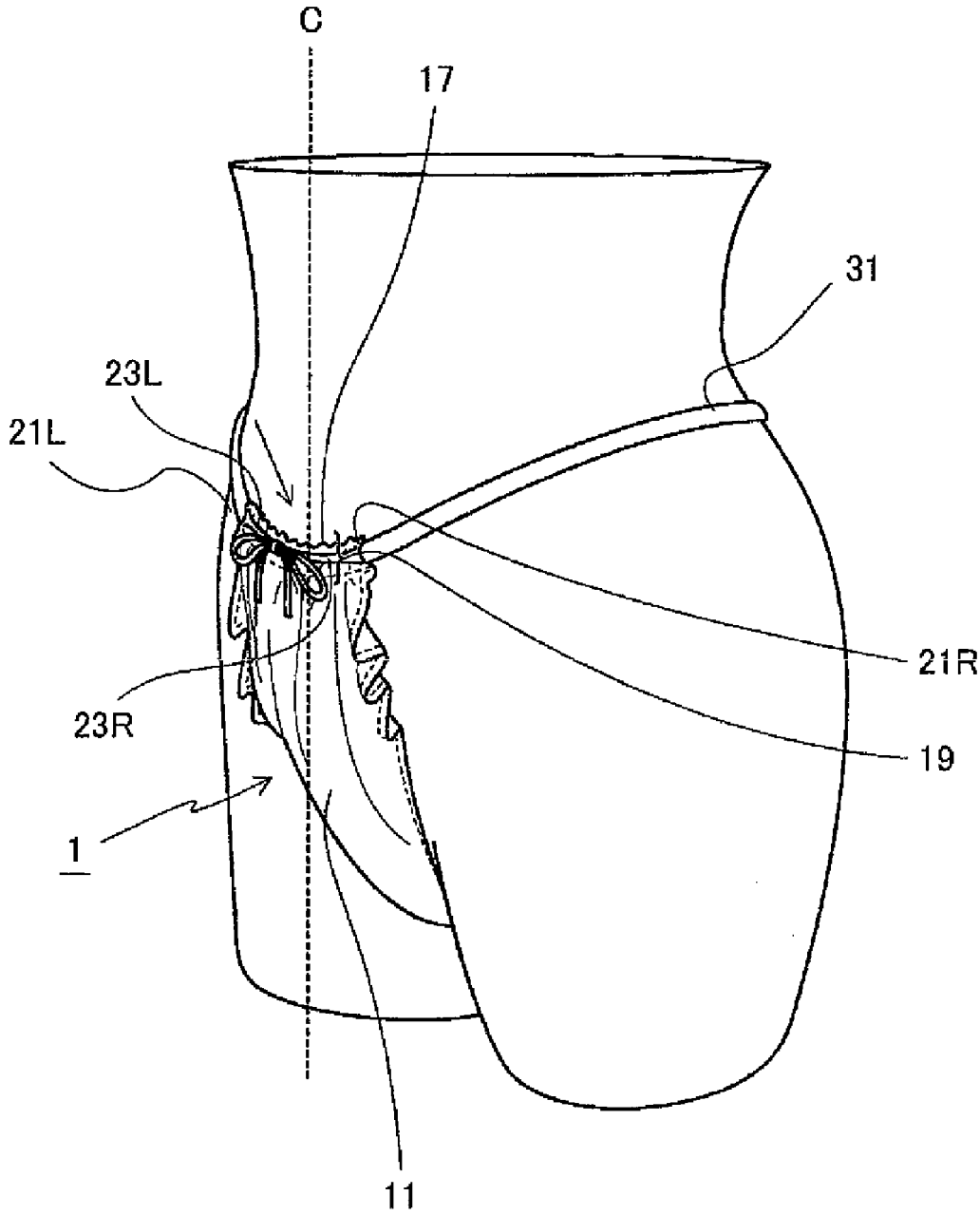
FIG. 11: Perspective view of the external appearance of the shorts (1) when they have been changed

With this construction, as shown in FIGS. 11 and/or 14, as the shorts (1) are worn and the front cover (11) is drawn to the narrow-width state, the free ends of the first string-shaped material (23L) and the second string-shaped material (23R) can be fastened together. By this, the movement of the left end (21L) of the upper hem (17) of the front cover (11) is regulated not to slide from the center along the string (31) to the left side of the person's pelvis, at the same time that of the right end (21R) of the upper hem (17) of the front cover (11) is regulated not to slide from the center along the string (31) to the right side of the person's pelvis. As a result, it becomes possible to retain the shape of the front cover (11) at the narrow-width state.

In the same manner, with regard to the back cover (12), when it is drawn to the narrow-width state as the shorts (1) are worn, the free ends of the third string-shaped material (24L) and the fourth string-shaped material (24R) are tied together (drawings omitted). By this, the movement of the left end (22L) of the upper hem (18) of the back cover (12) is regulated not to slide from the center along the string (31) to the left side of the person's pelvis, at the same time that of the right end (22R) of the upper hem (18) of said back cover (12) is regulated not to slide from the center along the string (31) to the right side of the person's pelvis. As a result, it becomes possible to retain the shape of the back cover (12) at the narrow-width state.

Figure 12:
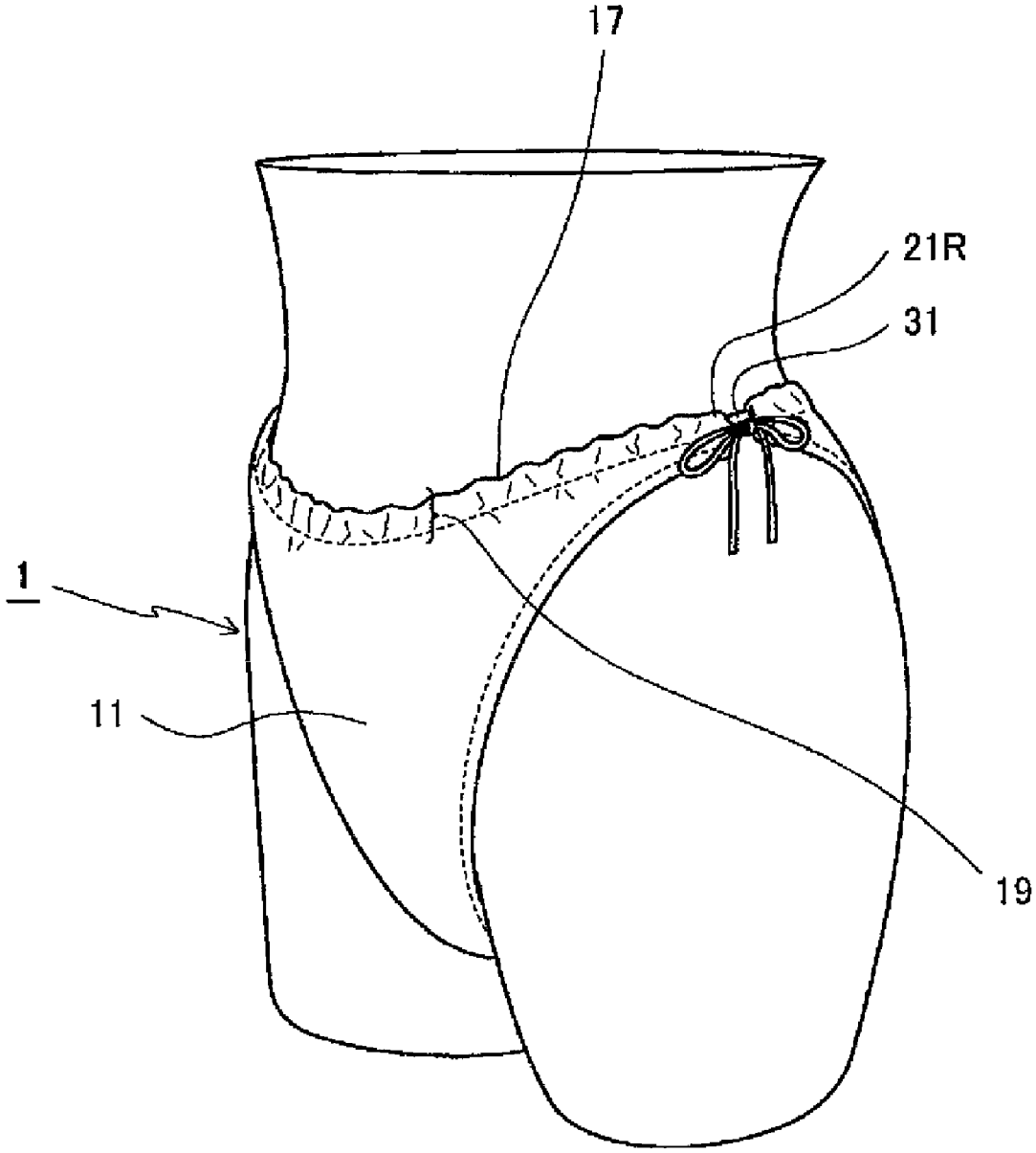
FIG. 12: Perspective view of the external appearance of the shorts (1) while being worn
Figure 15:
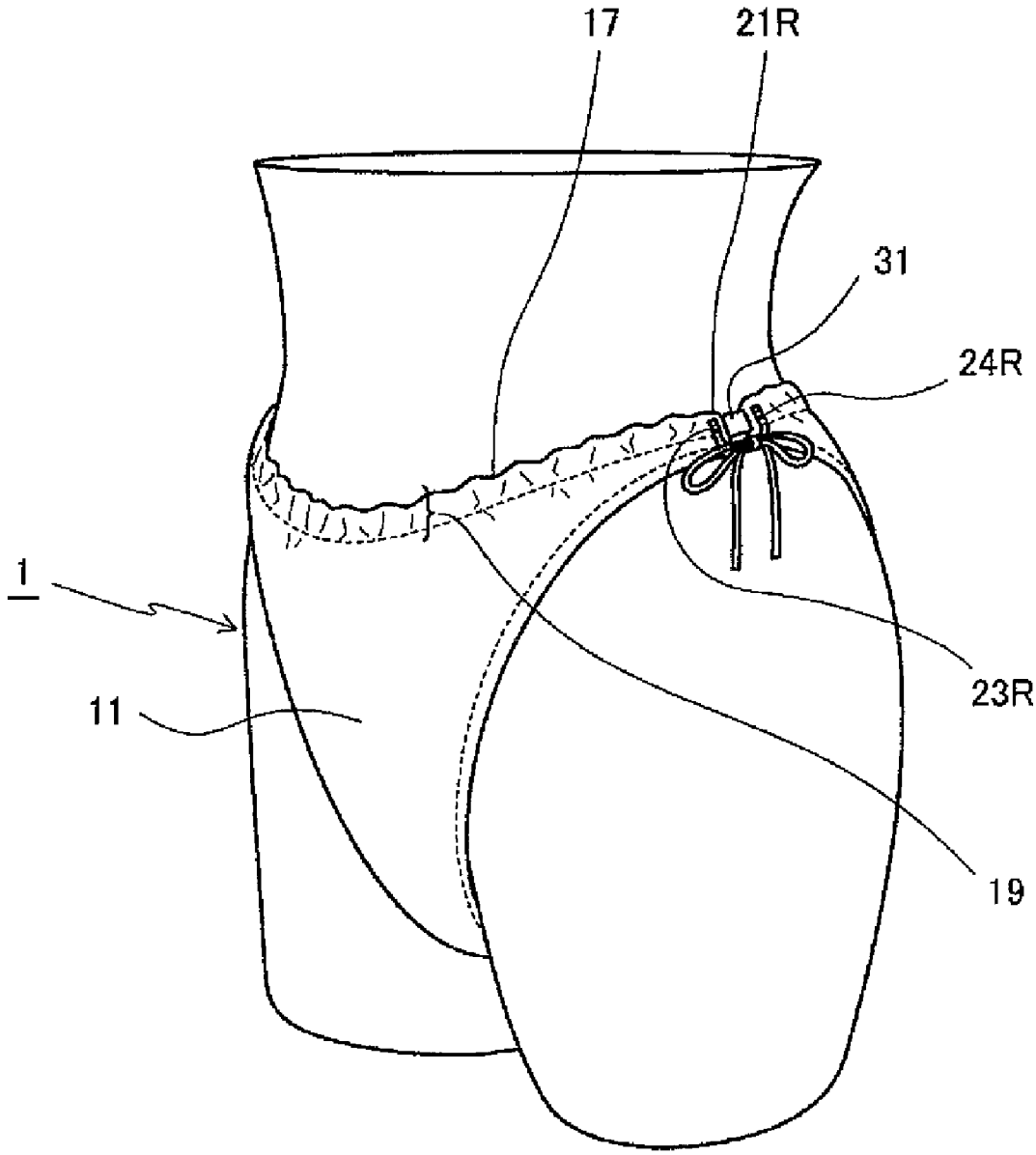
FIG. 15: Perspective view of the external appearance of the shorts (1) while being worn

Additionally, as shown in FIGS. 12 and 15, when the shorts (1) are worn and the front and back covers (11 and 12) are not drawn to the narrow-width state, the free ends of the second string-shaped material (23R) and the fourth string-shaped material (24R), and those of the first string-shaped material (23L) and the third string-shaped material (24L) are tied together respectively. By this, the left and the right ends (21L and 21R) of the upper hem (17) of the front cover (11) as well as the left and the right ends (22L and 22R) of the upper hem (18) of the back cover (12) can be restricted from sliding from the left and the right sides towards the center along the string (31). As a result, it is possible to retain the front cover (11) and the back cover (12) at the normal state.

As described in the above, explanation of the embodiment is described. The present invention is not limited to those. In other words, concrete constitution of the approximately inverted triangular front cover, the approximately inverted triangular back cover, string and string through passage provided in the shorts of the present invention may be optionally modified as long as it is within the purpose of the present invention.

In the embodiment, as a concrete solution in order not to allow both ends of the upper hem of the front and back covers to slide beyond the approximate center of the upper hem, the string through passages (19 and 20) in gather-shape are provided in each of the front and the back covers (11 and 12) as well as a structure is adopted wherein the length of the string through passages (19 and 20) is approximately half of the circumference of the string (31). The present invention can adopt, despite the above description, other structures.

As an example, a structure may be adopted wherein the approximate center (C) of the upper hem of the front cover (11) as well as the approximate center (C) of the upper hem of the back cover (12) at relative points of the string (31) are fixed. In further detail, as an example, approximate centers (C) of the upper hems (17 and 18) can be fixed by suturing them to the string (31).

Such solutions enable to increase certainty of preventing the narrow-width states, when drawn from the normal state, being formed off the center (C) on either side. As a result, it becomes possible not to unnecessarily burden the wearer physically and/or psychologically.

Further, for example, it is possible to adopt a construction wherein the width of the string through passages (19 and 20), through which the string (31) is inserted, becomes gradually narrower towards the center areas. Any size can be adopted as specific width of the string through passages (19 and 20) at the center areas but, for example, any width which is slightly narrower than that of the string (31) can be adopted. In this way, friction between the upper hems (17 and 18) of the front and back covers (11 and 12) and the string (31) increases towards the center, increasing certainty of preventing the narrow-width states, when drawn from the normal state, being formed off the center (C) on either side.

Further, in the embodiment, a flat-shaped rubber is adopted as the string (31), wherein the ends are connected to make the ring-shape. Without limiting to above, another construction can be adopted for the present invention; to describe in a way of example, the ring-shape can be constructed with string-shaped material having free ends which are tied to make the ring-shape. With this, it becomes possible to adjust the length of the string of the shorts in accordance with size of waist of the wearers and/or their taste, which is favorable in unnecessarily limiting the applicable wearers.

In this, the free ends of the string (31) can hang outside of the sections between the left end (21L) of the upper hem (17) of the front cover (11) and the left end (22L) of the upper hem (18) of the back cover (12), or between the right end (21R) of the upper hem (17) of the front cover (11) and the right end (22R) of the upper hem (18) of the back cover (12). It is necessary that the string (31) has enough length so that free ends can be tied together with respective others. Incidentally, in this case, the string (31) can be constructed with non-elastic materials if the case may be.

In the embodiment, the front cover (11) and the back cover (12) are constituted with two separate pieces of fabric, the present invention does not always require this constitution. In other words, the front cover (11) and the back cover (12) can be constituted with one piece of fabric instead wherein the tops of the two approximately inverted rectangular front and back covers (11 and 12) are connected. In other words, it is good enough if they are constituted in forms to cover the crotch and buttocks of a person in an integrated form of the front and back covers (11 and 12), and the specific manner of their connection can be optionally changed as the case may be.

In the embodiment, it is described that suturing is to be used in connecting the front and the back covers (11 and 12) at their tops, forming the string through passages and making the flat-shaped rubber into circular form. The present invention does not restrict the manner to be as described above. Instead, heat sealing, connection with adhesive agents and/or combination of these can be adopted.

If elastic materials such as rubber are used for the string (31) in the embodiment, it is good enough if the material is of elastic, resilient and/or stretching nature and its shape, materiality and quantity can be changed optionally as the case may be.

As for textile to constitute non-woven fabric, it is possible to choose fabrics which suit most favorably for the use in clothing and/or hygienic or medical purposes from natural fibers, such as cotton and/or pulp, synthetic fibers, such as rayon, polyester and/or polypropylene, and/or combination of these.

In the embodiment, non-woven fabric is adopted which is suitable for disposable use in consideration of the wearers' mental hygiene. The present invention does not restrict the fabric as described above. It is possible to adopt woven fabrics as used generally for underwear. Depending on the selection of the kinds of material for the fabric, the shorts can be used as fashionable shorts and/or swimming shorts. Furthermore, they are applicable as underwear for men.

The effects described in the embodiment, list only most favorable effects deriving from the present invention and the effects of the present invention are not limited to those described in the embodiment.

What is claimed is:

1. Shorts comprising:

an approximately inverted triangular front cover and an approximately inverted triangular back cover connected together at tops thereof for covering a lower abdomen, crotch and buttocks of a wearer while being worn, the front cover and the back cover having a string through-passage formed in upper hems thereof, respectively, and a width of the string throughpassage being gradually narrowed from opposing ends of the string throughpassage and toward the center of the string throughpassage; and a ring-shaped string inserted into the string throughpassages formed in the upper hems of the front and back covers in a freely slidable manner, both ends of the upper hems of the front and back covers being configured to be slidable along the string toward each other, thereby to change configuration of the front and back covers to a narrow-width configuration to cover the lower abdomen, the crotch and the buttocks; and first, second, third and fourth tie-strings, the first tie-string being connected to a left end of the upper hem of the front cover, the second tie-string being connected to a right end of the upper hem of the front cover, the third tie-string being connected to a left end of the upper hem of the back cover, and the fourth tie-string being connected to a right end of the upper hem of the back cover whereby, when the wearer wears the shorts and the configuration of the front and back covers is changed to the narrow-width configuration, left and right side segments of the ring-shaped string are retained at left and right sides of a pelvis of the wearer and front and back segments of the ring-shaped string are changed to be approximately V shape at a front and back of the wearer.

2. Shorts according to claim 1, wherein the upper hems of the front and back covers and the string are configured so that sliding together of the ends of the upper hems of the front and back covers does not displace center portions of the upper hems along the string.

3. Shorts according to claim 1, wherein the string is constituted of an elastic material.

4. Shorts according to claim 1, wherein center portions of the upper hems of the front and back covers are fixed to the string.

5. Shorts according to claim 1, wherein the ring-shaped string is constituted of a string having a pair of ends and arranged in a ring-shape with the ends fastened together.

* * * * *